US005638588A

United States Patent [19]

Jungkind

[11] Patent Number: 5,638,588

[45] Date of Patent: Jun. 17, 1997

[54] SHOE CLOSURE MECHANISM WITH A ROTATING ELEMENT AND ECCENTRIC DRIVING ELEMENT

[75] Inventor: Roland Jungkind, Garmisch-Partenkirchen, Germany

[73] Assignee: PUMA Aktiengesellschaft Rufolf Dassler Sport, Germany

[21] Appl. No.: 516,336

[22] Filed: Aug. 17, 1995

[30] Foreign Application Priority Data

Aug. 20, 1994 [DE] Germany ..... 9413360 U

[51] Int. Cl.[6] ..... A43C 11/00

[52] U.S. Cl. ..... 24/68 SK

[58] Field of Search ..... 24/68 R, 68 SK, 24/69 SK, 70 SK, 71 SK, 71.1; 36/50.5, 50.1

[56] References Cited

U.S. PATENT DOCUMENTS

| | | | |
|---|---|---|---|
| 4,748,726 | 6/1988 | Schoch | 24/68 SK |
| 4,961,544 | 10/1990 | Biodoia | 24/68 SK |
| 5,152,038 | 10/1992 | Schoch | 24/68 SK |

*Primary Examiner*—James R. Brittain

*Attorney, Agent, or Firm*—Sixbey, Friedman, Leedom & Ferguson, P.C.; David S. Safran

[57] ABSTRACT

A shoe closure mechanism having a rolling disk which lies on a bottom wall of a housing part, with the rolling disk being a flat, narrow ring whose inner face forms an inner gearing and whose outer face forms a rotatable guide path with the inner wall of a peripheral edge of the housing part. Furthermore, an eccentric driving disk lies on the bottom wall of the housing part within the rolling disk in the same plane with it. A cable pulley lies on the rolling disk and the eccentric driving disk, and it engages with drive pegs in circular openings of the eccentric driving disk and rotates on a section of an axle unit. The driving disk has a central hole which receives an eccentric driving peg that projects axially from the axle unit into a central opening of the driving disk. A bearing peg projects from the eccentric driving peg centrally with respect to the axis of rotation into a bearing hole of the housing part, and a driving projection projects from the axle unit, on the side opposite the eccentric driving peg and the bearing peg, into a hole of a rotating element that closes the top of the housing part. The driving projection is rigidly coupled with the rotating element. At least one opening that aligns with recesses of the rolling disk is provided in the housing part, and a fixing pin of a spring clip removably engages in the opening.

8 Claims, 1 Drawing Sheet

SHOE CLOSURE MECHANISM WITH A ROTATING ELEMENT AND ECCENTRIC DRIVING ELEMENT

BACKGROUND OF THE INVENTION

1. Field of the Invention

This invention relates to a shoe closure mechanism with a rotating element and a cable pulley coupled with it by an eccentric driving element, the cable pulley being provided in a housing part made of a bottom and an axially projecting peripheral edge. In particular, where an eccentric drive peg is coupled with the rotating element and engages, centered, in an eccentric driving disk that has an outer gearing, can rotate and is guided to move parallel to the cable pulley, and where the cable pulley, by drive pegs placed on it that engage in circular openings of the eccentric driving disk, is coupled with the eccentric driving disk. Still further, to such an arrangement with a pivoted rolling disk with an inner gearing lying parallel to the cable pulley and on which the outer gearing of the eccentric driving disk can roll, and with at least one recess on the periphery of the rolling disk in which a fixing element can engage and secure the rolling disk against rotation.

2. Description of Related Art

Such a shoe closure mechanism is known from PCT/DE93/01140 (the U.S. National Phase of which is application number 08/446,732) or German Patent Application 43 16 340. In these shoe closure mechanisms, the rolling disk with the internal gearing is made as a solid disk with a central beating hole for the axle unit and the internal gearing is located on the inner surface of an axially projecting edge rim formed on the rolling disk. The solid rolling disk and the eccentric driving disk are arranged lying atop one another. The rolling disk has, on the outer edge, one or more fastening means with which it can be fastened to the housing part so as not to rotate, in one or more rotation positions.

SUMMARY OF THE INVENTION

The primary object of the present invention is to provide a shoe closure mechanism of the above-mentioned type that can be more economically produced, especially for children's shoes.

Another object of the present invention is provide a shoe closure mechanism of the above-mentioned type that has a reduced overall height.

These objects are achieved by a shoe closure mechanism having a rolling disk that lies on a bottom wall of a housing part, with the rolling disk being a flat, narrow ring whose inner face forms an inner gearing and whose outer face forms a rotatable guide path with the inner wall of a peripheral edge of the housing part. Furthermore, an eccentric driving disk lies on the bottom wall of the housing part within the rolling disk in the same plane with it. A cable pulley lies on the rolling disk and the eccentric driving disk, and it engages with drive pegs in circular openings of the eccentric driving disk and rotates on a section of an axle unit. The driving disk has a central hole which receives an eccentric driving peg that projects axially from the axle unit into a central opening of the driving disk. A bearing peg projects from eccentric driving peg centrally with respect to the axis of rotation into a bearing hole of the housing part, and a driving projection projects from the axle unit, on the side opposite the eccentric driving peg and the beating peg, into a hole of a rotating dement that closes the top of the housing part. The driving projection is rigidly coupled with the rotating element. At least one opening that aligns with recesses of the rolling disk is provided in the housing part, and a fixing pin of a spring clip removably engages in the opening.

The invention makes it possible for the thickness of the rolling disk to be considerably decreased. It is not necessary to support it on the axle unit and the lock-in position of the rolling disk can be undone in a simple way to quickly to open the shoe closure mechanism. The height of the shoe closure mechanism is determined essentially by only the thickness of the cable pulley with the driving pegs, the housing bottom and the rotating element.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 1:
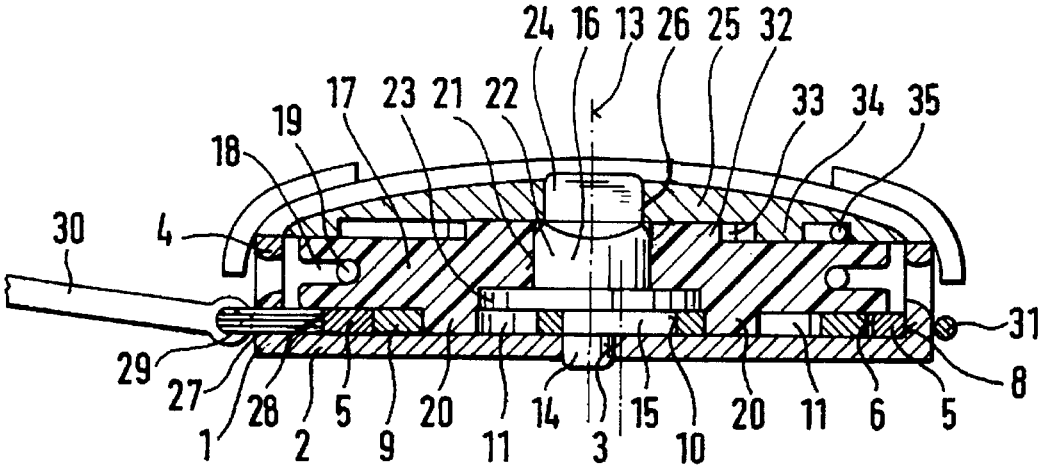
FIG.1 is a cross-sectional side view of a shoe closure mechanism according to a preferred embodiment of the invention taken along line I—I of FIG. 2.
Figure 2:
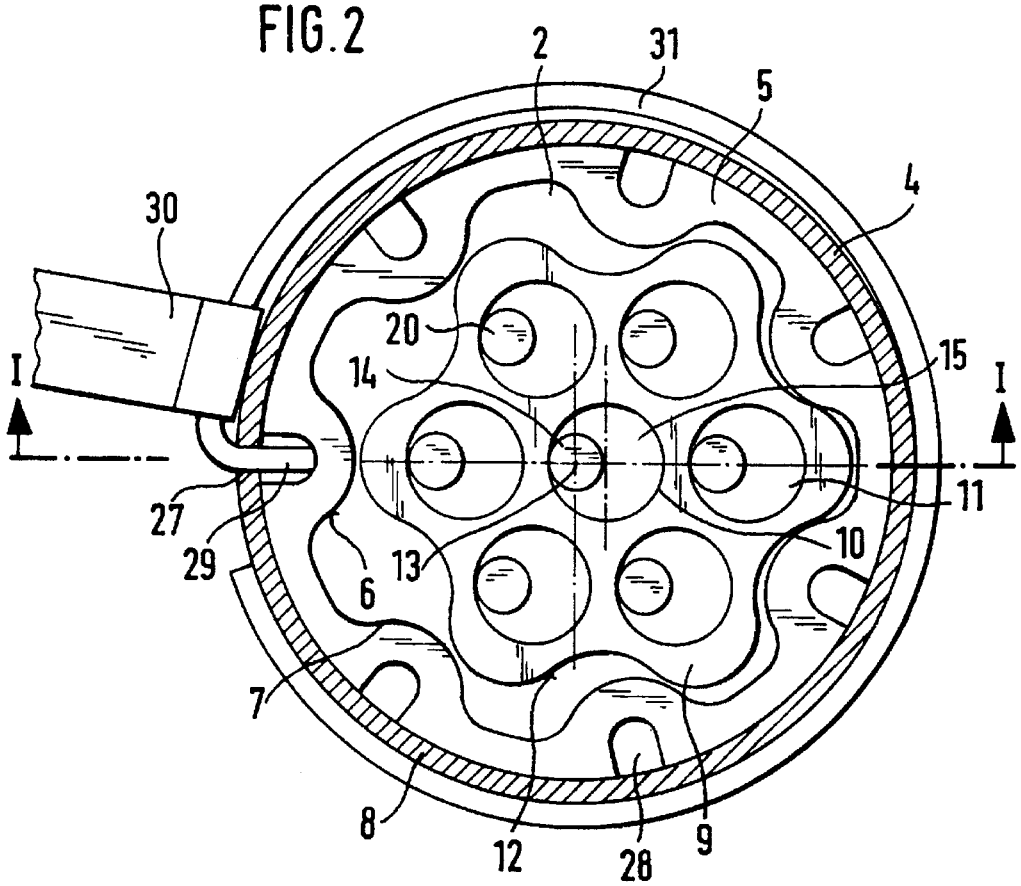
FIG. 2 is top plan view of the housing part with an inserted rolling disk and eccentric driving disk.

In the drawing, 1 designates a housing part which has a bottom part 2 with a central beating hole 3 and a peripheral edge 4 that projects axially upward.

On a rolling disk 5 in the form of a flat, narrow ring whose inner front face 6 is provided with an internal gearing 7 lies the bottom wall surface of the bottom part 2. The outer peripheral face 8 of the rolling disk 5 is matched in diameter to the inner diameter of peripheral edge 4 of housing part 1 with just sufficient clearance to enable disk 5 to rotate.

Inside rolling disk 5 lies an eccentric driving disk 9. The disk 9 has a central beating hole 10 and circular openings 11 arranged concentrically to it, as well as outer gearing 12. The disk 9 is located in the same plane as the rolling disk 5 and also lies on bottom part 2 of housing part 1.

Rolling disk 5 and eccentric driving disk 9 are preferably made as stampings of steel, so that their thickness can be about 1 mm or even less.

A bearing peg 14 is centered with respect to axis of rotation 13 and projects into beating hole 3 of the bottom part 2, and an eccentric driving peg 15 of an axle unit 16 projects into bearing hole 10 of the eccentric driving disk 9. Both of the pegs 14, 15 have a length that corresponds approximately to the thickness of bottom part 2 or of eccentric driving disk 9 or of rolling disk 5.

A cable pulley 17 lies on the rolling disk 5 and on eccentric driving disk 9. This cable pulley 17 has a guide groove 18 in its peripheral face for a tensioning element 19 in the form of a plastic or metal wire or the like. Tensioning element 19 is guided to out of the housing 1 through openings in its peripheral edge 4. Driving pegs 20 are arranged in a circle that is centered with respect to the axis of rotation 13 and project from the cable pulley 17 into a respective one of the circular openings 11 of the eccentric driving disk 9. The cable pulley 17 is preferably made of plastic.

To rotatably support cable pulley 17, it is provided with a central, tiered bearing hole 21, with which it receives a shaft projection 22 and a diametrally larger flange disk 23 of axle unit 16 on which it rotates.

A rotating element 25 is rotationally fixed on a driving projection 24, e.g., by having a keyed or noncircularly matching hole 26, which receives the projection 24 that, preferably, is in the shape of a polyhedron and projects above cable pulley 17.

In peripheral edge 4 of housing part 1 there is provided at least one opening 27 that is or are aligned with one of several radial recesses 28 in the outer edge of the rolling disk 5. A spring-like, elastically flexible fixing pin 29 projects into opening 27, and it can engage, with pretensioning, in one of recesses 28. The fixing pin 29 can be pulled out of corresponding recess 28 by a pulling element 30 made, for example, of a fabric or leather strap. In this way, the rotational locking of rolling disk 5 is released and cable pulley 17, including eccentric driving element and rotating element 25, can be rotated for quick opening of the shoe closure mechanism.

Fixing pin 29 is angled inward on an end of a spring clip 31 that has been bent into an open ring. The open ring of spring clip 31 spans housing part 1, squeezing it. Pulling element 30 is looped around spring clip 31 in the area of fixing pin 29 and can be operated, i.e., pulled, from the outside.

An upward-projecting stop rim 32, with stop means made as stop dogs 33, is provided on cable pulley 17. The rotating element 25 has a peg 34 which serves as a holding device for a stop spring 35, which can effect a stop moment with stop dogs 33. Stop dogs 33 can also be placed on rotating element 25 and the stop spring 35 on cable pulley 17.

A closure mechanism of the type described above will find utility as the central rotary closure for the tightening element a shoe such as those disclosed in, e.g., U.S. Pat. Nos. 5,117,567; 5,177,882 and 5,181,331. By rotating the rotating element 25, the tightening element can be wound on to the pulley 17 drawing the sides of the shoe together toward the throat area of the shoe. As the pulley rotates, the disk 5 will be driven by the eccentric 9 with pin 29 resiliently disengaging itself from the recess 28 that it is in and snapping back into the next recess 28 as it is brought into alignment with it to hold the tensioning element 19 against unwinding when the rotating element 25 is released. To open the shoe, as note above, pulling on pulling dement 30 will disengage the pin 29, allowing the tensioning element to fully unwind, releasing the holding forces applied to the sides of the shoe upper, so that the wearer's foot can be removed from the shoe.

While a single embodiment in accordance with the present invention has been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Shoe closure mechanism comprising a housing part, a rotating element that closes a top side of the housing part, a cable pulley coupled with the rotating element by an eccentric driving element, the cable pulley being located in a housing part having a bottom wall and an axially projecting peripheral edge, an eccentric drive peg coupled with the rotating element and centrally engaged in an eccentric driving disk that has outer gearing, and is rotatably mounted to move parallel to the cable pulley, the cable pulley having drive pegs on it that engage in circle openings of the eccentric driving disk, coupling the cable pulley with the eccentric driving disk, and with a pivoted rolling disk having an inner gearing lying parallel to the cable pulley and on which the outer gearing of the eccentric driving disk can roll, and with at least one recess on the periphery of the rolling disk in which a fixing element can engage and secure the rolling disk against rotation, wherein the rolling disk lies on the bottom wall of the housing part; wherein the rolling disk is a flat, narrow ring, an inner face of which forms the inner gearing and an outer face of which forms a rotatable guide path with an inner wall of the peripheral edge of the housing part; wherein the eccentric driving disk lies on said bottom wall inside an open space of the rolling disk in the same plane therewith; wherein the cable pulley lies on the rolling disk and the eccentric driving disk; wherein the cable pulley is pivoted centrally on a section of an axle unit; wherein the eccentric driving disk has a central hole by which it is rotatably mounted on an eccentric driving peg that projects axially from the axle unit; wherein a bearing peg is centrally located with respect to an axis of rotation, projecting from the eccentric driving peg into a bearing hole of the housing part; wherein a driving projection projects from the axle unit, on a side opposite said eccentric driving peg and bearing peg, into a hole of the rotating element; wherein the driving projection is rigidly coupled with the, rotating element; wherein at least one opening that aligns with recesses of the rolling disk is provided in the housing part; and wherein a fixing pin of a spring clip is engagable with the recesses of the rolling disk via at least one opening of the housing, the fixing pin being provided with pulling means for enabling it to be pulled outwardly relative to said recesses.

2. Shoe closure mechanism according to claim 1, wherein a spring clip comprises an open spring ring from which said fixing pin extends inwardly at an angle; wherein the spring ring is disposed around a peripheral wall of the housing part, squeezing it; and wherein said pulling means comprises a pulling element which acts on the spring ring in an area near the fixing pin.

3. Shoe closure mechanism according to claim 2, wherein a pulling element is formed of a fabric or leather strap.

4. Shoe closure mechanism according to claim 3, wherein the driving projection of the axle unit and the hole in the rotating element have a polyhedron shape.

5. Shoe closure mechanism according to claim 2, wherein the driving projection of the axle unit and the hole in the rotating element have a polyhedron shape.

6. Shoe closure mechanism according to claim 1, wherein stop dogs are provided on an inner side of one of the rotating element and a side the cable pulley facing the rotating element, and wherein a stop spring interacts with the stop dogs and is mounted on the other of the rotating element and a side the cable pulley facing the rotating element.

7. Shoe closure mechanism according to claim 6, wherein the driving projection of the axle unit and the hole in the rotating element have a polyhedron shape.

8. Shoe closure mechanism according to claim 1, wherein the driving projection of the axle unit and the hole in the rotating element have a polyhedron shape.

* * * * *